United States Patent [19]

McElroy, Jr. et al.

[11] Patent Number: 4,861,295

[45] Date of Patent: Aug. 29, 1989

[54] MARINE PROPULSION DEVICE WITH REVERSIBLE SHIFT APPARATUS

[75] Inventors: Kennedy K. McElroy, Jr., Lindenhurst; Jeffrey P. Higby, Waukegan, both of Ill.; Philip A. Zorc, St. Joseph, Mich.

[73] Assignee: Outboard Marine Corporation, Waukegan, Ill.

[21] Appl. No.: 167,789

[22] Filed: Mar. 14, 1988

[51] Int. Cl.[4] ..... B63H 21/28

[52] U.S. Cl. ..... 440/86; 74/378; 440/75

[58] Field of Search ..... 440/75, 86; 74/378, 74/335, 388 R

[56] References Cited

U.S. PATENT DOCUMENTS

| | | | |
|---|---|---|---|
| 2,696,188 | 12/1954 | Armstrong | 115/18 |
| 2,718,792 | 9/1955 | Kiekhaefer | 74/378 |
| 2,728,320 | 6/1953 | Kloss | 115/18 |
| 2,729,186 | 7/1953 | Kloss | 115/18 |
| 4,527,441 | 7/1985 | Nakahama | 74/378 |
| 4,549,869 | 10/1985 | Iida | 440/84 |
| 4,579,204 | 4/1986 | Iio | 192/21 |
| 4,637,802 | 1/1987 | Taguchi | 440/49 |
| 4,668,198 | 5/1987 | Nakamura | 440/75 |

*Primary Examiner*—Sherman D. Basinger
*Assistant Examiner*—Thomas J. Brahan
*Attorney, Agent, or Firm*—Michael, Best & Friedrich

[57] ABSTRACT

A marine propulsion device comprising a lower unit including a propeller shaft mounted for rotation about an axis, a propeller mounted on the propeller shaft, a drive gear, and a transmission including an actuator movable along the propeller shaft axis for selectively effecting driving engagement between the drive gear and the propeller shaft, an engine drivingly connected to the drive gear, a shift member movable along an axis transverse to the propeller shaft axis, and a mechanism selectively connectable, in alternative first and second conditions, between the shift member and the actuator for moving the actuator in opposite first and second directions along the propeller shaft axis in response to movement of the shift member in opposite directions, the mechanism moving the actuator in the first direction when connected in the first condition and when the shift member is moved in one direction, and the mechanism moving the actuator in the second direction when connected in the second condition and when the shift member is moved in the one direction.

23 Claims, 1 Drawing Sheet

MARINE PROPULSION DEVICE WITH REVERSIBLE SHIFT APPARATUS

BACKGROUND OF THE INVENTION

The invention relates to marine propulsion device shift apparatus, and, more particularly, to apparatus for shifting a reversible transmission in the lower gearcase of a marine propulsion device.

The prior art includes many such shift apparatus. Typically, a reversible transmission in the lower gearcase of a marine propulsion device includes a control member which is movable axially of the propeller shaft for actuating the transmission. The shift apparatus provides means for moving the control member axially in response to operator actuation of a remotely located control device.

An example of a prior art shift apparatus is disclosed is U.S. Hagen Pat. No. 3,919,964. Referring to FIG. 6, Hagen discloses a shift apparatus including a vertically movable actuating rod 57, a control member or shift actuator 51 movable axially of the propeller shaft, and means for moving the control member forwardly in response to downward movement of the actuating rod 57 and rearwardly in response to upward movement of the actuating rod 57.

When two marine propulsion devices are used on a single boat, it is preferable to have the propellers counter-rotating, i.e., rotating in opposite directions in the forward drive condition. Also, it is preferable to have shifting of the two marine propulsion devices controlled by a single remotely located control device. In order to have both counter-rotating propellers and a single control device it has previously been necessary for the two marine devices to have either different transmissions or different shift apparatus. For example, U.S. Taguchi Pat. No. 4,637,802 discloses four different arrangements for shifting identical transmissions in a pair of outboard motors with counter-rotating propellers. In each arrangement, the outboard motors have different shift apparatus, i.e., the shift apparatus are not identical. This necessitates manufacturing two different sets of parts.

Attention is directed to the following U.S. Patents:

| | U.S. Pat. No. | |
|---|---|---|
| Armstrong | 2,696,188 | Dec. 7, 1954 |
| Kloss | 2,729,186 | Jan. 3, 1956 |
| Kloss | 2,728,320 | Dec. 27, 1955 |
| Nakahama | 4,527,441 | Jul. 9, 1985 |
| Iida | 4,549,869 | Oct. 29, 1985 |
| Iio | 4,579,204 | Apr. 1, 1986 |
| Taguchi | 4,637,802 | Jan. 20, 1987 |

SUMMARY OF THE INVENTION

The invention provides a marine propulsion device comprising a lower unit including a propeller shaft mounted for rotation about an axis, a propeller mounted on the propeller shaft, a drive gear, and a transmission including an actuator movable along the propeller shaft axis for selectively effecting driving engagement between the drive gear and the propeller shaft, an engine drivingly connected to the drive gear, a movable shift member, and means selectively connectable, in alternative first and second conditions, between the shift member and the actuator for moving the actuator in opposite first and second directions along the propeller shaft axis in response to movement of the shift member in opposite directions, the means moving the actuator in the first direction when connected in the first condition and when the shift member is moved in one direction, and the means moving the actuator in the second direction when connected in the second condition and when the shift member is moved in the one direction.

In one embodiment, the means includes a first member connectable to the shift member for common movement therewith and with alternative first and second orientations relative to the shift member, and means for moving the actuator in the first direction in response to movement of the first member in the one direction along the transverse axis when the first member is connected to the shift member with the first orientation, and for moving the actuator in the second direction in response to movement of the first member in the one direction along the transverse axis when the first member is connected to the shift member with the second orientation.

In one embodiment, the means includes a second member connectable to the actuator for common axial movement therewith and with alternative first and second orientations relative to the actuator, and means for moving the second member in the first direction in response to movement of the shift member in the one direction along the transverse axis when the second member is connected to the actuator with the first orientation, and for moving the second member in the second direction in response to movement of the shift member in the one direction along the transverse axis when the second member is connected to the actuator with the second orientation.

In one embodiment, the shift member is movable along an axis transverse to the propeller shaft axis, and the one direction extends along the transverse axis.

In one embodiment, the means includes a first member connected to the shift member, a second member connected to the actuator, and interengaging means on the first and second members.

In one embodiment, the interengaging means includes a groove located in one of the first and second members and inclined relative to the propeller shaft axis, and a projection located on the other of the first and second members and received in the groove.

In one embodiment, the interengaging means includes, in one of the first member and the second member, a groove which slopes in the one direction along the transverse axis and in the second direction when the first member is oriented in the first direction, and which slopes in the one direction along the transverse axis and in the first direction when the first member is oriented in the second direction, and, on the other of the first member and the second member, a projection which is slideably received in the groove which slopes in the one direction along the transverse axis and in the second direction when the second member is oriented in the first direction, and which slopes in the one direction along the transverse axis and in the first direction when the second member is oriented in the second direction.

In one embodiment, the shift member has an end, the first member is mounted on the end of shift member, and the first member has therein a pair of apertures spaced in the direction of the propeller shaft axis, one of the apertures receiving the end when the first member is oriented in the first direction, and the other of the apertures receiving the end when the first member is oriented in the second direction.

In one embodiment, the first member is U-shaped and includes a generally horizontal base connected to the shift member and a pair of spaced apart legs extending downwardly from the base, each of the legs having therein a groove which slopes in the one direction along the transverse axis and in the second direction when the first member is oriented in the first direction, and which slopes in the one direction along the transverse axis and in the first direction when the first member is oriented in the second direction, and the second member includes a first projection received in the groove in one of the legs, and a second projection received in the groove in the other of the legs.

The invention also provides a marine propulsion assembly adapted to be mounted on a boat, the assembly comprising a first marine propulsion device including a lower unit having a propeller shaft mounted for rotation about an axis, a propeller mounted on the propeller shaft, a drive gear, and a transmission including an actuator movable along the propeller shaft axis for selectively effecting driving engagement between the drive gear and the propeller shaft, an engine drivingly connected to the drive gear, a shift member movable along an axis transverse to the propeller shaft axis, and means connected between the shift member and the actuator for moving the actuator in opposite directions along the propeller shaft axis in response to movement of the shift member in opposite directions along the transverse axis, the means including a first member connected to the shift member, and a second member connected to the actuator, one of the first and second members having therein a groove inclined relative to the propeller shaft axis, and the other of the first and second members having thereon a projection received in the groove, and a second marine propulsion device including a second lower unit including a second propeller shaft mounted for rotation about a second axis, a second propeller mounted on the second propeller shaft, a second drive gear, and a second transmission including a second actuator movable along the second propeller shaft axis for selectively effecting driving engagement between the second drive gear and the second propeller shaft, a second engine drivingly connected to the second drive gear, a second shift member movable along a second axis transverse to the second propeller shaft axis, and second means connected between the second shift member and the second actuator for moving the second actuator in opposite directions along the second propeller shaft axis in response to movement of the second shift member in opposite directions along the second transverse axis, the second means including a third member which is substantially identical to the first member and which is connected to the second shift member, and a fourth member which is substantially identical to the second member and which is connected to the second actuator, one of the third and fourth members having therein a second groove inclined relative to the second propeller shaft axis, and the other of the third and fourth members having thereon a second projection received in the second groove.

A principal feature of the invention is the provision of means selectively connectable, in alternative first and second conditions, between the shift member and the actuator for moving the actuator in opposite directions in response to movement of the shift member in opposite directions, the means moving the actuator in a first direction axially of the propeller shaft when connected in the first condition and when the shift member is moved in one direction, and the means moving the actuator in an opposite second direction axially of the propeller shaft when connected in the second condition and when the shift member is moved in the one direction. This reversible means can be used in different marine propulsion devices having shift members which move in the same direction to cause forward drive, but one marine propulsion device having the forwardly located drive gear as the forward drive gear and the other having the rearwardly located drive gear as the forward drive gear. The reversible means would be connected in one condition in one of these marine propulsion devices, and in the other condition in the other of these marine propulsion devices.

The result is that, with the preferred embodiment of the invention, downward movement of the shift member in both marine propulsion devices causes forward driving rotation of the propeller shaft, even though the propeller shafts are rotating in opposite directions.

This arrangement also allows the power head shift linkage, i.e., the linkage between the remote control device and the shift member, to be reversed without changing the transmission. Thus, upward movement of the shift member can cause forward drive in one marine propulsion device, and downward movement of the shift member can cause forward drive in another marine propulsion device.

Another principal feature of the invention is the provision of a first member connected to the shift member, and a second member connected to the actuator, with one of the members having therein a groove inclined relative to the propeller shaft axis, and the other of the members having thereon a projection received in the groove.

Another principal feature of the invention is the provision of a member mounted on the lower end of the shift member, the member having therein a pair of horizontally spaced apertures, one of the apertures receiving the lower end of the shift member when the member is oriented rearwardly, and the other of the apertures receiving the lower end of the shift member when the members are oriented forwardly.

Another principal feature of the invention is the provision of a member mounted on the lower end of the shift member, the member having therein a single aperture receiving the lower end of the shift member both when the member is oriented rearwardly and when the member is oriented forwardly.

Other features and advantages of the invention will become apparent to those skilled in the art upon review of the following detailed description, claims, and drawings.

Figure 1:
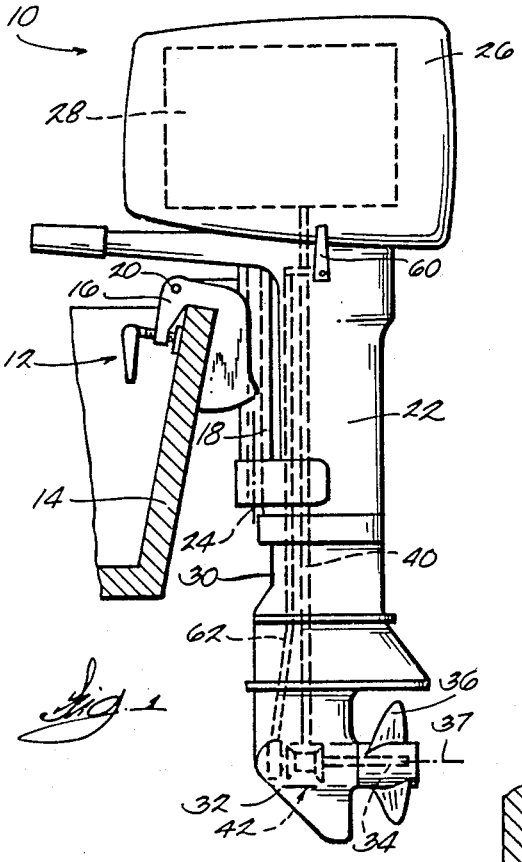
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. It should be understood that while the illustrated device 10 is an outboard motor, the invention is applicable to other types of devices, such as stern drives.

As shown in FIG. 1, the marine propulsion device 10 comprises a mounting bracket or assembly 12 fixedly mounted on the transom 14 of a boat. In the preferred embodiment, the assembly 12 includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24, and for common pivotal movement therewith about the tilt axis 20. The propulsion unit 22 includes a power head 26 which includes an internal combustion engine 28. The propulsion unit 22 also includes a lower unit 30 which supports the power head 26 and which includes a lower gearcase 32.

Figure 2:
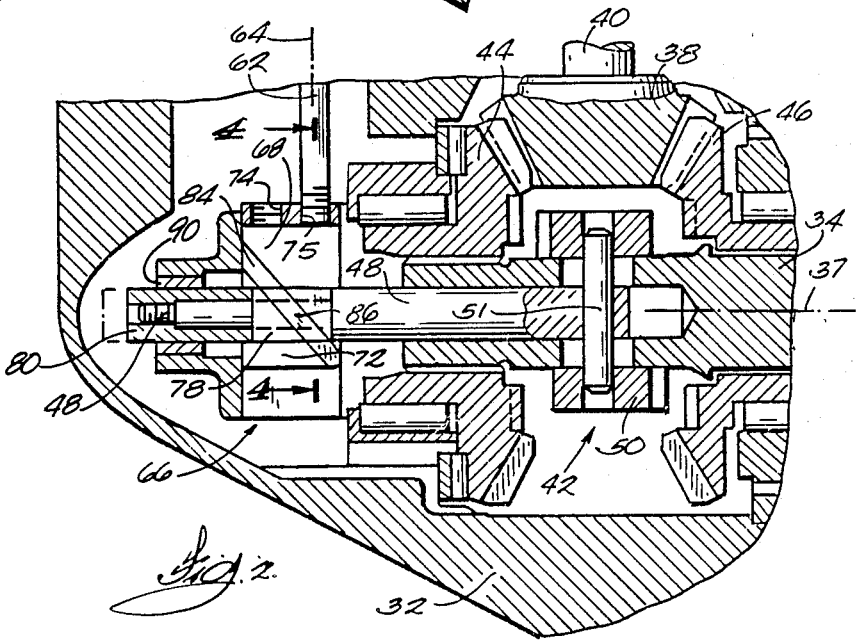
FIG. 2 is an enlarged, partial, vertical cross-sectional view of the marine propulsion device with the first and second members oriented forwardly.

As shown in FIGS. 1 and 2, the marine propulsion device 10 also comprises a generally horizontal propeller shaft 34 having thereon a propeller 36 and being mounted in the lower gearcase 32 for rotation about a generally horizontal axis 37, and a drive bevel gear 38 rotatably mounted in the lower gearcase 32. The engine 28 is drivingly connected to the drive gear 38 by a drive train 40.

The marine propulsion device 10 further comprises a reversible transmission 42 for selectively effecting driving engagement between the drive gear 38 and the propeller shaft 34. While various suitable transmissions can be employed, in the preferred embodiment, the transmission 42 is located in the lower gearcase 32 and includes (see FIG. 2) a pair of facing, axially spaced bevel gears 44 and 46 which are rotatably supported in the gearcase 32 coaxially with the propeller shaft 34 and which mesh with the drive gear 38. The transmission 42 also includes a dog clutch 50 which is splined to the exterior of the propeller shaft 34 for common rotation therewith and which is movable axially of the propeller shaft 34 for selective and alternative engagement with the spaced bevel gears 44 and 46.

The transmission also includes an actuator 48 which extends through an axial bore in the propeller shaft 34 and which is movable axially of the propeller shaft 34 or along the propeller shaft axis 37. The actuator 48 has thereon a pin 51 which is fixed to the dog clutch 50 for moving the dog clutch 50 with the actuator 48 axially of the propeller shaft 34. Thus, the actuator 48 is movable axially of the propeller shaft 34 for selectively and alternatively causing driving engagement between the bevel gears 44 and 46 and the propeller shaft 34. Such an arrangement is disclosed in full detail in U.S. Hagen Pat. No. 3,919,964, which is incorporated herein by reference.

The marine propulsion device 10 also comprises operator actuated means for selectively moving the actuator 48 axially of the propeller shaft 34. While various suitable means can be employed, in the preferred embodiment, this means includes a shift lever 60 (FIG. 1) pivotally mounted on the propulsion unit 22, and a shift rod or member 62 (FIGS. 1 and 2) extending along a generally vertical axis 64. The shift rod 62 has a lower end, and an upper end operatively connected to the shift lever 60 such that pivotal movement of the shift lever 60 causes vertical movement of the shift rod 62. Pivotal movement of the shift lever 60 can be controlled by any suitable means (not shown) such as a conventional remote control lever.

To facilitate the use of counter-rotating propellers 36 (which in the known art reverse the positions of the forward drive and rearward drive bevel gears), while always having downward movement of the shift rod 62 shift the transmission into the same drive condition, i.e., the forward drive condition or the rearward drive condition, the means for moving the actuator 48 also includes means 66 selectively connectable, in alternative first and second conditions, between the shift rod 62 and the actuator 48 for moving the actuator 48 in opposite directions along the propeller shaft axis 37 in response to movement of the shift rod 62 in opposite directions, the means 66 moving the actuator 48 in a first or forward direction along the propeller shaft axis 37 when connected in the first condition and when the shift rod 62 is moved downwardly, and the means 66 moving the actuator 48 in an opposite second or rearward direction when connected in the second condition and when the shift rod 62 is moved downwardly.

Figure 3:
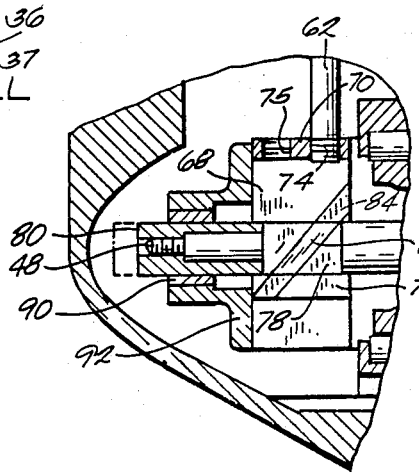
FIG. 3 is a view similar to FIG. 2 of a second marine propulsion device with the first and second members oriented rearwardly.

While various suitable means 66 can be employed, in the preferred embodiment, the means 66 includes a first member 68 connectable to the lower end of the shift rod 62 for common movement therewith and with alternative first and second or forward and rearward orientations relative to the shift rod 62. In the preferred embodiment, the first member 68 is U-shaped and includes a generally horizontal base 70 and a pair of spaced apart legs 72 extending downwardly from the base 70. The base 70 has therein a pair of threaded apertures 74 and 75 spaced horizontally or in the direction of the propeller shaft axis 37, with the aperture 74 threadedly receiving the lower end of the shift rod 62 when the first member 68 is oriented rearwardly (FIG. 3), and with the aperture 75 threadedly receiving the lower end of the shift rod 62 when the first member 68 is oriented forwardly (FIG. 2).

Figure 5:
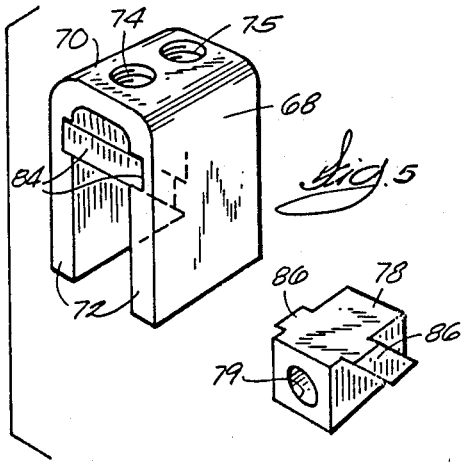
FIG. 5 is an exploded perspective view of the first and second members.

The means 66 also includes a second member 78 connectable to the actuator 48 for common axial movement therewith, for rotation relative thereto, and with alternative first and second or forward and rearward orientations relative to the actuator 48. In the preferred embodiment, the second member 78 includes an axial bore 79 (FIG. 5) rotatably receiving the forward end of the actuator 48, and the second member 78 is secured on the actuator 48 for rotation relative thereto by a cylindrical member 80 which is threaded onto the forward end of the actuator 48. In order to support the forward end of the actuator 48 for axial movement, the cylindrical member 80 is slideably supported by a bushing 90. The bushing 90 is mounted within a housing 92 which is in turn mounted within the lower gearcase 32.

The means 66 also includes interengaging means on the first and second members 68 and 78. While various suitable interengaging means can be used, in the illustrated construction, the interengaging means includes a groove or grooves 84 located in one of the first and second members and inclined relative to the propeller shaft axis 37, and a projection or projections 86 located on the other of the first and second members 68 and 78 and slideably received in the groove or grooves 84. In the preferred embodiment, the first member 68 includes, in each leg 72, a groove 84 which slopes downwardly and rearwardly when the first member 68 is oriented forwardly, and which slopes downwardly and forwardly when the first member 68 is oriented rearwardly. Concomitantly, the second member 78 includes a pair of opposed, horizontally extending projections 86 which slope downwardly and rearwardly when the second member 78 is oriented forwardly, and slope downwardly and forwardly when the second member 78 is oriented rearwardly.

It should be understood that in alternative embodiments the second member 78 can include the groove or grooves 84 and the first member 68 can include the projection or projections 86.

Thus, the second member 78 moves the actuator 48 forwardly in response to downward movement of the first member 68 when the first member 68 is connected to the shift rod 62 with a forward orientation, and moves the actuator 48 rearwardly in response to downward movement of the first member 68 when the first member 68 is connected to the shift rod 62 with a rearward orientation. Also, the first member 68 moves the second member 78 forwardly in response to downward movement of the shift rod 62 when the second member is connected to the actuator 48 with a forward orientation, and moves the second member 78 rearwardly in response to downward movement of the shift rod 62 when the second member 78 is connected to the actuator 48 with a rearward orientation.

The means 66 operates as follows:

When the first and second members 68 and 78 are respectively connected to the shift rod 62 and the actuator 48 in the first condition, or with forward orientations, downward movement of the shift rod 62 acts through the first and second members 68 and 78 to cause forward movement of the actuator 48. Alternatively, upward movement of the shift rod 62 acts through the first and second members 68 and 78 to cause rearward movement of the actuator 48.

When the first and second members 68 and 78 are connected between the shift rod 62 and the actuator 48 in the second condition, or with rearward orientations, downward movement of the shift rod 62 acts through the first and second members 68 and 78 to cause rearward movement of the actuator 48, and upward movement of the shift rod 62 acts through the first and second members 68 and 78 to cause forward movement of the actuator 48.

Figure 6:
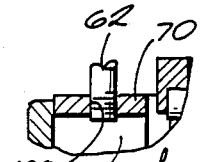
FIG. 6 is a partial view similar to FIG. 3 and showing an alternative embodiment of the invention.
Figure 4:
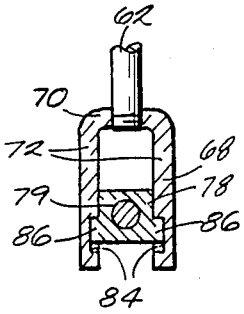
FIG. 4 is a view taken along line 4—4 in FIG. 2.

An alternative embodiment of the invention is illustrated in FIG. 6. The alternative embodiment is similar to the preferred embodiment, and common elements have been given the same reference numerals.

In the alternative embodiment, the base 70 of the first member 68 has therein a single threaded aperture 100 rather than the pair of apertures 74 and 75 of the preferred embodiment. The single aperture 100 is centered (in the direction of the propeller shaft axis 37) on the first member 68 so that it can threadedly receive the lower end of the shift rod 62 both when the first member 68 is oriented rearwardly and when the first member 68 is oriented forwardly.

Various features of the invention are set forth in the following claims.

We claim:

1. A marine propulsion device comprising a lower unit including a propeller shaft mounted for rotation about an axis, a drive gear, and a transmission including an actuator movable along said propeller shaft axis for selectively effecting driving engagement between said drive gear and said propeller shaft, and engine drivingly connected to said drive gear, a movable shift member, and means including a member selectively connectable, in alternative first and second conditions, between said shift member and said actuator for moving said actuator in opposite first and second directions along said propeller shaft axis in response to movement of said shift member in opposite generally vertical directions, said means moving said actuator in said first direction along said propeller shaft axis when said member is connected to said first condition and when said shift member is moved in one generally vertical direction, and said means moving said actuator in said second direction along said propeller shaft axis when said member is connected in said second condition and when said shift member is moved in said one generally vertical direction.

2. A marine propulsion device as set forth in claim 1 wherein said member comprises a connecting member connectable to said shift member for common movement therewith and in alternative first and second orientations relative to said shift member, and means for moving said actuator in said first direction in response to movement of said connecting member in said one direction along an axis transverse to said propeller shaft axis when said connecting member is connected to said shift member in said first orientation, and for moving said actuator in said second direction in response to movement of said connecting member in said one direction along said transverse axis when said connecting member is connected to said shift member in said second orientation.

3. A marine propulsion device as set forth in claim 1 wherein said member comprises a connecting member connectable to said actuator for common axial movement therewith and in alternative first and second orientations relative to said actuator and means for moving said connecting member in said first direction in response to movement of said shift member in said one direction along an axis transverse to said propeller shaft axis when said second member is connected to said actuator in said first orientation, and for moving said connecting member in said second direction in response to movement of said shift member in said one direction along said transverse axis when said connecting member is connected to said actuator in said second orientation.

4. A marine propulsion device as set forth in claim 1 wherein said means includes a first member connected to said shift member, a second member connected to said actuator, and interengaging means on said first and second members.

5. A marine propulsion device as set forth in claim 1 wherein said shift member is movable along an axis transverse to said propeller shaft axis, and wherein said one direction extends along said transverse axis.

6. A marine propulsion device as set forth in claim 5 wherein said means includes a first member connected to said shift member, a second member connected to said actuator, and interengaging means on said first and second members.

7. A marine propulsion device as set forth in claim 6 wherein said interengaging means includes a groove located in one of said first and second members and inclined relative to said propeller shaft axis, and a projection located on the other of said first and second members and received in said groove.

8. A marine propulsion device as set forth in claim 6 wherein said interengaging means includes, in one of said first member and said second member, a groove which slopes in said one direction along said transverse axis and in said second direction when said first member is oriented in said first direction, and which slopes in said one direction along said transverse axis and in said first direction when said first member is oriented in said second direction, and, on the other of said first member and said second member, a projection which is slideably received in said groove which slopes in said one direction along said transverse axis and in said second direction when said second member is oriented in said first direction, and which slopes in said one direction along said transverse axis and in said first direction when said second member is oriented in said second direction.

9. A marine propulsion device as set forth in claim 8 wherein said shift member has an end, wherein said first member is mounted on said end of said shift member, and wherein said first member has therein a pair of apertures spaced in the direction of said propeller shaft axis, one of said apertures receiving said end when said first member is oriented in said first direction, and the other of said apertures receiving said end when said first member is oriented in said second direction.

10. A marine propulsion device as set forth in claim 8 wherein said first member is U-shaped and includes a generally horizontal base connected to said shift member and a pair of spaced apart legs extending downwardly from said base, each of said legs having therein a groove which slopes in said one direction along said transverse axis and in said second direction when said first member is oriented in said first direction, and which slopes in said one direction along said transverse axis and in said first direction when said first member is oriented in said second direction, and wherein said second member includes a first projection received in said groove in one of said legs, and a second projection received in said groove in the other of said legs.

11. A marine propulsion device comprising a lower unit including a propeller shaft mounted for rotation about a generally horizontal axis, a drive gear, and a transmission including an actuator movable along said propeller shaft axis for selectively effecting driving engagement between said drive gear and said propeller shaft, an engine drivingly connected to said drive gear, a shift member movable along a generally vertical axis, and means selectively connectable, in alternative first and second conditions, between said shift member and said actuator for moving said actuator in opposite directions along said propeller shaft axis in response to movement of said shift member in opposite directions, said means moving said actuator forwardly when connected in said first condition and when said shift member is moved downwardly, and said means moving said actuator rearwardly when connected in said second condition and when said shift member is moved downwardly.

12. A marine propulsion device as set forth in claim 11 wherein said means includes a connecting member connectable to said shift member for common movement therewith and in alternative rearward and forward orientations relative to said shift member, and means for moving said actuator rearwardly in response to downward movement of said connecting member when said connecting member is connected to said shift member in said rearward orientation, and for moving said actuator forwardly in response to downward movement of said connecting member when said connecting member is connected to said shift member in said forward orientation.

13. A marine propulsion device as set forth in claim 11 wherein said means includes a connecting member connectable to said actuator for common axial movement therewith and in alternative rearward and forward orientations relative to said actuator, and means for moving said connecting member rearwardly in response to downward movement of said shift member when said connecting member is connected to said actuator in said rearward orientation, and for moving said connecting member forwardly in response to downward movement of said shift member when said connecting member is connected to said actuator in said forward orientation.

14. A marine propulsion device as set forth in claim 11 wherein said means includes a first member connected to said shift member, a second member connected to said actuator, and interengaging means on said first and second members.

15. A marine propulsion device as set forth in claim 14 wherein said interengaging means includes a groove located in one of said first and second members and inclined relative to said propeller shaft axis, and a projection located on the other of said first and second members and received in said groove.

16. A marine propulsion device as set forth in claim 14 wherein said interengaging means includes, in one of said first member and said second member, a groove which slopes downwardly and rearwardly when said first member is oriented forwardly, and which slopes downwardly and forwardly when said first member is oriented rearwardly, and, on the other of said first member and said second member, a projection which is slideably received in said groove which slopes downwardly and rearwardly when said second member is oriented forwardly, and which slopes downwardly and forwardly when said second member is oriented rearwardly.

17. A marine propulsion device as set forth in claim 16 wherein said shift member has a lower end, wherein said first member is mounted on said lower end of said shift member, and wherein said first member has therein a pair of horizontally spaced apertures, one of said apertures receiving said lower end when said first member is oriented rearwardly, and the other of said apertures receiving said lower end when said first member is oriented forwardly.

18. A marine propulsion device as set forth in claim 16 wherein said first member is U-shaped and includes a generally horizontal base connected to said shift member and a pair of spaced apart legs extending downwardly from said base, each of said legs having therein a groove which slopes downwardly and rearwardly when said first member is oriented forwardly, and which slopes downwardly and forwardly when said first member is oriented rearwardly, and wherein said second member includes a first projection received in said groove in one of said legs, and a second projection received in said groove in the other of said legs.

19. A marine propulsion device comprising a lower unit including a propeller shaft mounted for rotation about a generally horizontal axis, a drive gear, and a transmission including an actuator movable along said propeller shaft axis for selectively effecting driving engagement between said drive gear and said propeller shaft, an engine drivingly connected to said drive gear, a shift member movable along a generally vertical axis, and means selectively connectable, in alternative first and second conditions, between said shift member and said actuator for moving said actuator in opposite directions along said propeller shaft axis in response to movement of said shift member in opposite directions, said means including a first member connectable to said shift member for common movement therewith and with alternative rearward and forward orientations relative thereto, said first member having therein a groove which slopes downwardly and rearwardly when said first member is connected to said shift member with said forward orientation, and which slopes downwardly and forwardly when said first member is connected to said shift member with said rearward orientation, and a second member connectable to said actuator for common axial movement therewith and with alternative rearward and forward orientations relative thereto, said second member including a projection which is slideably received in said groove.

20. A marine propulsion device as set forth in claim 19 wherein said shift member has a lower end, wherein said first member is mounted on said lower end of said shift member, and wherein said first member has therein a pair of horizontally spaced apertures, one of said apertures receiving said lower end when said first member has said rearward orientation, and the other of said apertures receiving said lower end when said first member has said forward orientation.

21. A marine propulsion device as set forth in claim 19 wherein said first member is U-shaped and includes a generally horizontal base connected to said shift member and a pair of spaced apart legs extending downwardly from said base, each of said legs having therein a groove which slopes downwardly and rearwardly when said first member is connected to said shift member with said forward orientation, and which slopes downwardly and forwardly when said first member is connected to said shift member with said rearward orientation, and wherein said second member includes a first projection received in said groove in one of said legs, and a second projection received in said groove in the other of said legs.

22. A marine propulsion device as set forth in claim 21 wherein said shift member has a lower end, wherein said first member is mounted on said lower end of said shift member, and wherein said base of said first member has therein a pair of horizontally spaced apertures, one of said apertures receiving said lower end when said first member has said rearward orientation, and the other of said apertures receiving said lower end when said first member has said forward orientation.

23. A marine propulsion assembly adapted to be mounted on a boat, said assembly comprising a first marine propulsion device including a lower unit having a propeller shaft mounted for rotation about an axis, a drive gear, and a transmission including an actuator movable along said propeller shaft axis for selectively effecting driving engagement between said drive gear and said propeller shaft, an engine drivingly connected to said drive gear, a shift member movable along an axis transverse to said propeller shaft axis, and means connected between said shift member and said actuator for moving said actuator in opposite directions along said propeller shaft axis in response to movement of said shift member in opposite directions along said transverse axis, said means including a first member connected to said shift member, and a second member connected to said actuator, one of said first and second members having therein a groove inclined relative to said propeller shaft axis, and the other of said first and second members having thereon a projection received in said groove, and a second marine propulsion device including a second lower unit including a second propeller shaft mounted for rotation about a second axis, a second drive gear, and a second transmission including a second actuator movable along said second propeller shaft axis for selectively effecting driving engagement between said second drive gear and said second propeller shaft, a second engine drivingly connected to said second drive gear, a second shift member movable along a second axis transverse to said second propeller shaft axis, and second means connected between said second shift member and said second actuator for moving said second actuator in opposite directions along said second propeller shaft axis in response to movement of said second shift member in opposite directions along said second transverse axis, said second means including a third member which is substantially identical to said first member and which is connected to said second shift member, and a fourth member which is substantially identical to said second member and which is connected to said second actuator, one of said third and fourth members having therein a second groove inclined relative to said second propeller shaft axis, and the other of said third and fourth members having thereon a second projection received in said second groove.

* * * * *